US007240931B1

(12) United States Patent
Casey

(10) Patent No.: US 7,240,931 B1
(45) Date of Patent: Jul. 10, 2007

(54) POSITIONABLE DOOR STRIKE

(76) Inventor: Michael J. Casey, 2025 Downing Dr., Pensacola, FL (US) 32505

( * ) Notice: Subject to any disclaimer, the term of this patent is extended or adjusted under 35 U.S.C. 154(b) by 0 days.

(21) Appl. No.: 11/143,302

(22) Filed: Jun. 3, 2005

(51) Int. Cl.
*E05B 15/02* (2006.01)
*E05B 15/00* (2006.01)

(52) U.S. Cl. ..... 292/341.18; 292/341.15; 292/288

(58) Field of Classification Search ..... 292/340, 292/341.18, 341.19, 341.12, DIG. 60, DIG. 73, 292/DIG. 55, DIG. 56, DIG. 57
See application file for complete search history.

(56) References Cited

U.S. PATENT DOCUMENTS

| | | | | | |
|---|---|---|---|---|---|
| 872,053 | A | * | 11/1907 | Christy | 292/341.18 |
| 1,059,530 | A | | 4/1913 | Dupuis | |
| 1,093,816 | A | | 4/1914 | Wiley | |
| 1,238,924 | A | | 9/1917 | Kennedy | |
| 1,272,115 | A | * | 7/1918 | Russell | 292/341.19 |
| 1,563,667 | A | | 12/1925 | Smith | |
| 1,733,412 | A | | 10/1929 | Karns | |
| 1,852,854 | A | | 4/1932 | Norring | |
| 2,013,145 | A | | 9/1935 | Goetz | |
| 2,086,049 | A | * | 7/1937 | Schlaman | 292/341.19 |
| 2,094,119 | A | | 9/1937 | Flora | |
| 2,153,080 | A | | 4/1939 | Flora | |
| 2,350,635 | A | * | 6/1944 | Pendleton | 292/341.18 |
| 2,403,182 | A | | 7/1946 | Leary et al. | |
| 2,572,428 | A | | 10/1951 | Anstine | |
| 2,592,274 | A | | 4/1952 | Groeger | |
| 2,695,807 | A | | 11/1954 | Bissot | |
| 2,695,808 | A | | 11/1954 | Manchester | |
| 2,713,506 | A | * | 7/1955 | Wickstrom | 292/341.18 |
| 2,781,219 | A | | 2/1957 | Bahonik | |
| 2,990,211 | A | | 6/1961 | Wartian | |
| 2,993,719 | A | | 7/1961 | Manchester | |
| 3,257,139 | A | | 6/1966 | Russell et al. | |
| 3,265,427 | A | | 8/1966 | Williams | |
| 3,287,055 | A | | 11/1966 | Schlage | |
| 3,401,487 | A | | 9/1968 | Brandt et al. | |
| 3,416,829 | A | | 12/1968 | Russell et al. | |
| 3,454,295 | A | | 7/1969 | Schlage et al. | |
| 3,506,293 | A | * | 4/1970 | Armstrong et al. | 292/341.19 |
| 4,105,235 | A | * | 8/1978 | Thiel | 292/341.18 |
| 4,171,836 | A | | 10/1979 | St. Aubin | |
| 4,288,120 | A | * | 9/1981 | Moore | 292/341.18 |
| 4,453,752 | A | | 6/1984 | McKann | |
| 4,492,397 | A | | 1/1985 | Allenbaugh | |
| 4,892,341 | A | | 1/1990 | Dietrich | |
| 4,893,854 | A | | 1/1990 | Dietrich | |
| 5,118,151 | A | | 6/1992 | Nicholas, Jr. et al. | |
| 6,588,155 | B1 | | 7/2003 | Theune et al. | |
| 2003/0137155 | A1 | | 7/2003 | Baranski | |

* cited by examiner

*Primary Examiner*—Brian E. Glessner
*Assistant Examiner*—Alyson Merlino
(74) *Attorney, Agent, or Firm*—J. Nevin Shaffer, Jr.

(57) ABSTRACT

An positionable door strike is attached to a door jamb and receives a corresponding door latch located on a swinging door. The positionable door strike has a base plate and a strike plate that is capable of horizontally sliding within a pair of channels located on the base plate. The base plate is secured to the jamb by passing screws through appropriate openings located on the base plate while the strike plate is held secure when it is slid to its desired position by passing one or more set screws through screw openings located on the strike plate, the set screws engaging the door jamb.

16 Claims, 2 Drawing Sheets

POSITIONABLE DOOR STRIKE

BACKGROUND OF THE INVENTION

1. Field of the Invention

The present invention relates to a horizontally positionable door strike mountable on a door jamb during new construction for receiving a latch mounted on a door.

2. Background of the Prior Art

A conventional door lock bolt or latch is mounted on a door and is cooperatively received within a strike mounted on the door jamb. A typical door strike is a stamped metal member having a suitable aperture for receiving the bolt or latch, which stamped metal member is secured to the door jamb by passing a pair of material appropriate screws through a pair of openings—one above the latch opening and one below the latch opening—and passing the screws into the door jamb. The latch aperture on the stamped metal member overlies a similar aperture located on the door jamb. When the door is closed, the bolt or latch is received within the aperture on the stamped metal member as and the opening on the door jamb therebehind, oftentimes guided thereinto in the case of a latch by a tongue that faces toward the door when opened.

In order for the above door arrangement to work effectively, a certain amount of precision is required when installing the lock-set. Especially important is the frontward vertical edge of the door strike—that vertical edge closest to the tongue—as this edge holds the bolt or latch whenever the door is closed and prevents the door from opening unintended. If this edge is too far rearward, the door may not close without substantial coaxing, if at all, and if this vertical edge is too far forward, the door will have substantial play when closed and will rattle and be annoying to the occupants of the building. The problem is that oftentimes a contractor will not take the requisite care to properly install the door, the door jamb and lock-set and once the door is closable, the contractor moves on to the next project, irrespective of whether door closure is proper or not.

A remedy for such problems is the use of a positionable strike. While many examples of adjustable strikes can be found in the art, such devices tend to be relatively complex in design and construction, making such devices relatively expensive to obtain and difficult to install and use.

Accordingly, there exists a need in the art for a device that allows a door bolt or latch to properly mate with a corresponding strike located on a jamb and that can overcome an improperly installed lock-set. Such a device must be of relatively simple design and construction so that it is relatively inexpensive to manufacture and should replace the existing conventional fixed mount strike plates that are installed during new construction.

SUMMARY OF THE INVENTION

The positionable door strike of the present invention addresses the aforementioned needs in the art. The positionable door strike allows for on the fly positioning of the door strike that is attached to a door jamb so that the strike appropriately receives a bolt or latch on a door whenever the door is closed. The infinite positionability of the present invention allows a door strike and latch combination to work properly with no discernible play or rattle. The positionable door strike is of relatively simple design and construction so that it is relatively inexpensive to manufacture and replaces the existing conventional fixed mount strike plates that are installed during new construction. The positionable door strike solves the problem of ill fitting door locks and requires little, if any, additional installation time or effort and dimensionally fits into the standard milled out strike plate pocket found on most pre-hung door unit jambs.

The positionable door strike of the present invention is comprised of a base plate that has a first aperture, an upper opening located above the first aperture, a lower opening located below the first aperture, an upper channel located above the first aperture, and a lower channel located below the first aperture. The base plate adapted to be attached to a door jamb. A strike plate has a second aperture such that the strike plate is received within the upper channel and the lower channel of the base plate and slides with respect to the base plate. At least one screw opening is located on strike plate such that a set screw passes through each screw opening and engages the door jamb in order to prevent the strike plate from sliding with respect to the base plate. The strike plate slides transversely with respect to a longitudinal axis of a leg of the door jamb to which the base plate is attached. A tongue is located on an end of the strike plate. The first aperture of the base plate has a main section and an upper extension extending forwardly toward the tongue and a second extension extending forward and spaced apart and generally coextensive with the first extension. A lip is located on an edge of the second aperture of the strike plate, the lip passing into the first aperture of the base plate.

BRIEF DESCRIPTION OF THE DRAWINGS

Similar reference numerals refer to similar parts throughout the several views of the drawings.

DESCRIPTION OF THE PREFERRED EMBODIMENT

Figure 1:
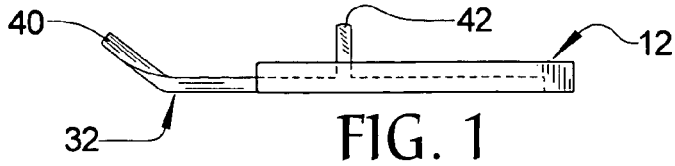
FIG. 1 is a top plan view of the positionable door strike of the present invention.
Figure 2:
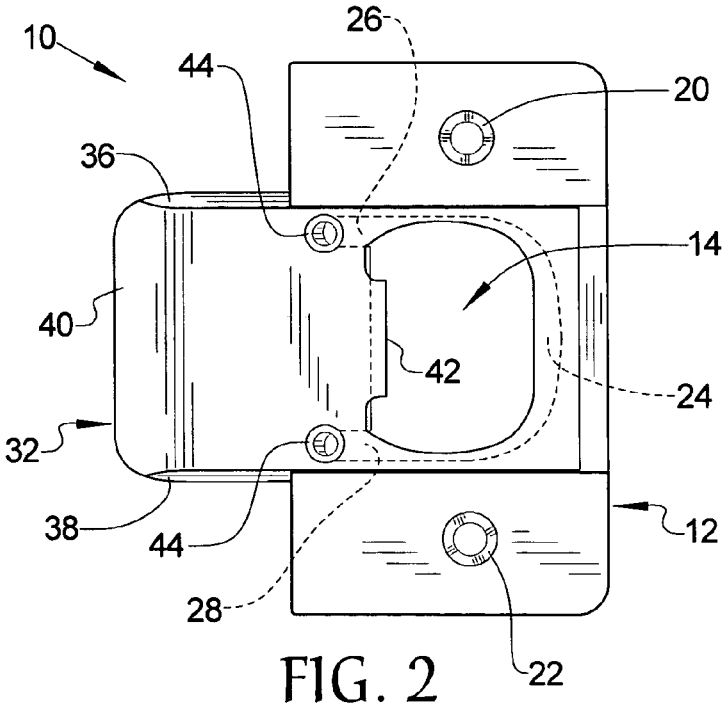
FIG. 2 is a front elevation view of the positionable door strike.
Figure 3:
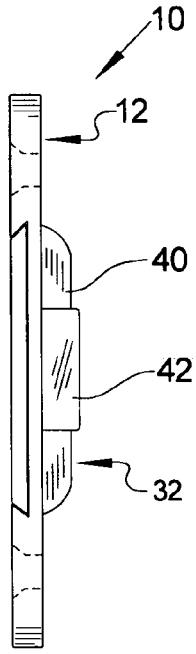
FIG. 3 is a right elevation view of the positionable door strike.
Figure 4:
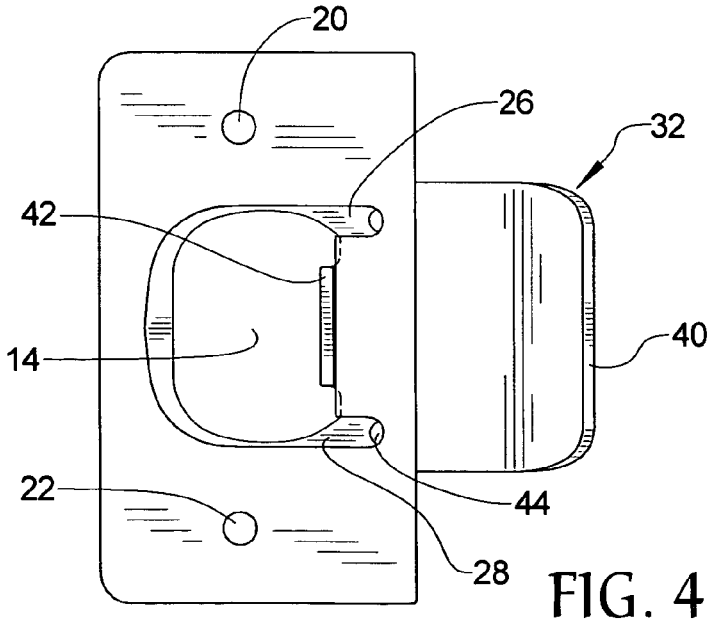
FIG. 4 is a rear elevation view of the positionable door strike.
Figure 5:
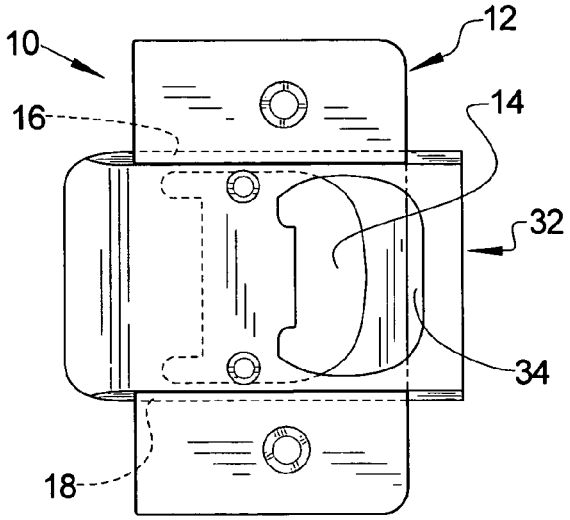
FIG. 5 is a front elevation view of the positionable door strike with the strike plate moved rearwardly.
Figure 6:
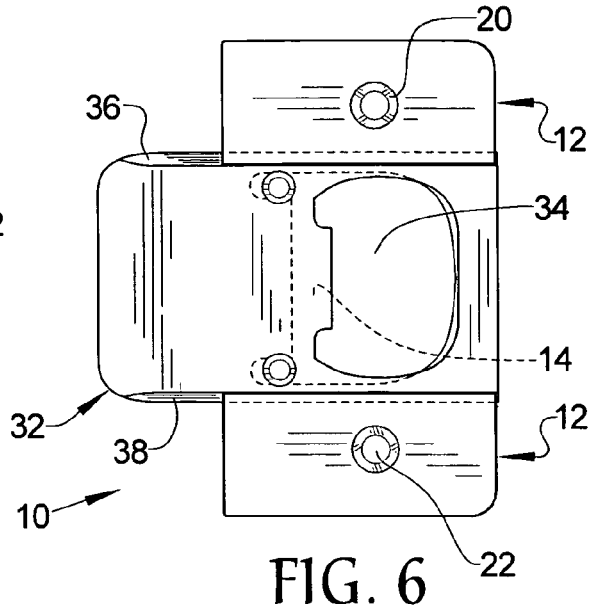
FIG. 6 is a front elevation view of the positionable door strike with the strike plate moved forwardly.
Figure 7:
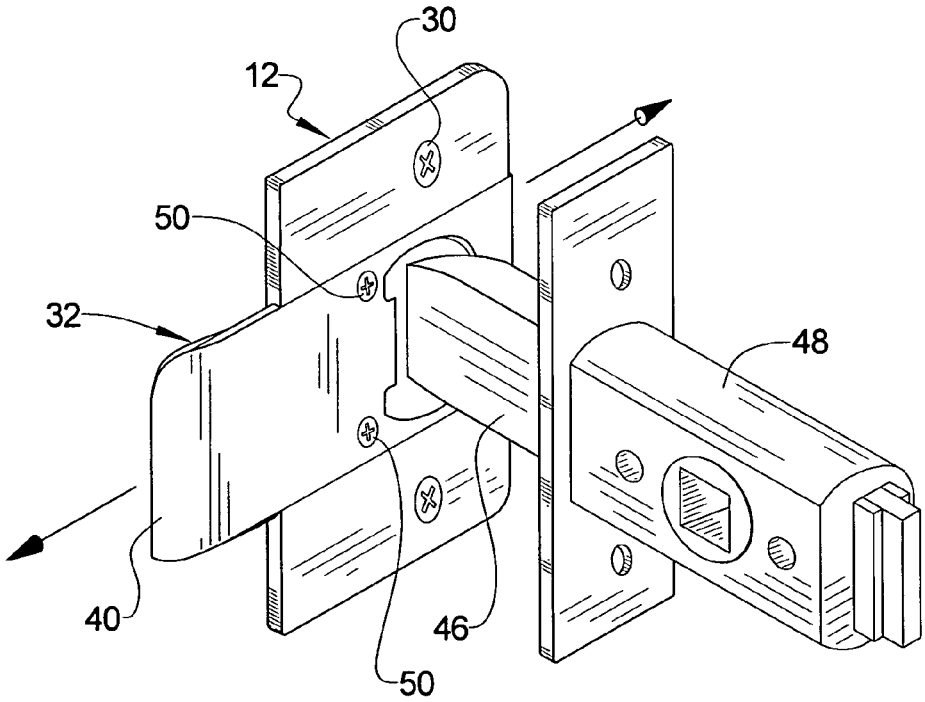
FIG. 7 is a perspective view of the positionable door strike about to receive a latch.

Referring now to the drawings, it is seen that the positionable door strike of the present invention, generally denoted by reference numeral 10, is comprised of a base plate 12 that has a first aperture 14, an upper channel 16, a lower channel 18, an upper opening 20, and a lower opening 22. As seen, the first aperture 14 has a main section 24, an upper extension 26 that extends forwardly and a lower extension 28 that also extends forwardly (the term forwardly being defined as that general direction which the door that uses the present invention 10 swings in going from a closed to an open position) and may be generally coextensive with the upper extension 26. The base plate 12, which may be made from any appropriate material such as metal, is attached to a door jamb by passing a screw 30 through the upper opening 20 and into the door jamb and passing another screw 30 through the lower opening 22 and into the door jamb. The first aperture 14 on the base plate 12 overlies a corresponding aperture on the door jamb.

A strike plate 32, which may be made from similar material used to make the base plate 12, has a second aperture 34, an upper edge 36, a lower edge 38, a forwardly facing tongue 40, a lip 42 that depends into the second aperture 34 and into the first aperture 14, and one or more screw openings 44. The strike plate 32 is positioned such that its its upper edge 36 is received within the upper channel 16 of the base plate 12 and the strike plate's lower edge 38 is received within the lower channel 18 of the base plate 12. In such a configuration, the strike plate 32 slides within the upper channel 16 and lower channel of the base plate 12. The lip 42 of the strike plate 32 limits forward sliding of the strike plate 32 with respect to the base plate 12, and also limits rear ward sliding of the strike plate 32 with respect to the base plate 12, although when the device 10 is installed on a door jamb, the stop of the door jamb limits reward sliding of the strike plate 32 with respect to the base plate 12. The second aperture 34 of the strike plate 32 overlies, at least partially, the first aperture 14 of the base plate 12 throughout the strike plate's intended range of travel with respect to base plate 12. The screw openings 44 overlie the first aperture 14 of the base plate 12 throughout the strike plate's intended range of travel with respect to the base plate 12, either the main section 24 of the first aperture 14 or the upper extension 26 and the lower extension 28 whenever the strike plate 32 is positioned forwardly with respect to the base plate 12.

The base plate 12 is attached to the door jamb by passing the screws 30 through the upper opening 20 and the lower opening 22. The strike plate 32 is thereafter adjusted so that the second aperture 34 of the strike plate 32 receives the latch 46 of a door latch mechanism 48 properly (the latch is actually received within the second aperture 34 (and underlying first aperture 14 of base plate 12) and is held snug therein so that the door does not rattle). Strike plate 32 movement is horizontal, or transverse with respect to the vertical leg onto which the positionable door strike 10 is installed. Once the strike plate 32 is at the desired position, appropriate screws 50, which may be set screws are passed through each screw opening 44 located on the strike plate 32. As each screw opening 44 overlies the first aperture 14 of the base plate 12, the screws 50 pass through the first aperture 14 and engage the door jamb and hold the strike plate 32 fast and prevent the strike plate 32 from sliding with respect to the base plate 12. The positionable door strike 10 is now ready to receive the door latch 46 in appropriate fashion, with the tongue acting as a latch guide in normal fashion.

While the invention has been particularly shown and described with reference to an embodiment thereof, it will be appreciated by those skilled in the art that various changes in form and detail may be made without departing from the spirit and scope of the invention.

I claim:

1. A strike comprising:

a base plate having a first aperture, an upper opening located above the first aperture, a lower opening located below the first aperture, an upper channel located above the first aperture, and a lower channel located below the first aperture, the base plate adapted to be attached to a door jamb; and a strike plate having at least one screw opening overlying said first aperture and a second aperture wherein said strike plate is received within the upper channel and the lower channel of the base plate and is adapted to slide with respect to the base plate.

2. The strike as in claim 1 wherein the strike plate is adapted to slide transversely with respect to a longitudinal axis of a leg of the door jamb to which the base plate is adapted to be attached.

3. The strike as in claim 1 further comprising a tongue located on an end of the strike plate.

4. The strike as in claim 3 wherein the first aperture of the base plate has a main section and an upper extension extending forwardly toward the tongue and a lower extension extending forwardlv toward the tongue and spaced apart and coextensive with said upper extension.

5. The strike as in claim 4 wherein said at least one screw opening overlying said first aperture also overlies said upper extension or said lower extension.

6. The strike as in claim 1 wherein the first aperture of the base plate has a main section and an upper extension extending forwardly and a lower extension extending forwardly and spaced apart and coextensive with said upper extension.

7. The strike as in claim 6 wherein said at least one screw opening overlying said first aperture also overlies said upper extension or said lower extension.

8. The strike as in claim 1 further comprising a lip located on an edge of the second aperture of the strike plate, the lip passing into the first aperture of the base plate.

9. A strike comprising:

a base plate having a first aperture, an upper channel located above the first aperture, a lower channel located below the first aperture, an upper opening located above the upper channel, and a lower opening located below the lower channel, the base plate adapted to be attached to a door jamb by passing a first screw through the upper opening and into the door jamb and passing a second screw through the lower opening and into the door jamb; and a strike plate having at least one screw opening overlying said first aperture and having an upper edge, a lower edge, and a second aperture such that the upper edge of the strike plate is received within the upper channel of the base plate and the lower edge of the strike plate is received within the lower channel of the base plate so that the strike plate is adapted to slide with respect to the base plate.

10. The strike as in claim 9 wherein the strike plate slides is adapted to slide transversely with respect to a longitudinal axis of a leg of the door jamb to which the base plate is adapted to be attached.

11. The strike as in claim 9 further comprising a tongue located on an end of the strike plate.

12. The strike as in claim 11 wherein the first aperture of the base plate has a main section and an upper extension extending forwardly toward the tongue and a lower extension extending forwardly toward the tongue and spaced apart and coextensive with the upper extension.

13. The strike as in claim 12 wherein said at least one screw opening overlying said first aperture also overlies said upper extension or said lower extension.

14. The strike as in claim 9 wherein the first aperture of the base plate has a main section and an upper extension extending forwardly and a lower extension extending forwardly and spaced apart and coextensive with the fist said upper extension.

15. The strike as in claim 14 wherein said at least one screw opening located on said strike plate overlies one of said upper extension or said lower extension.

16. The strike as in claim 9 further comprising a lip located on an edge of the second aperture of the strike plate, the lip passing into the first aperture of the base plate.

* * * * *